US006120862A

United States Patent [19]

Aouad et al.

[11] Patent Number: 6,120,862

[45] Date of Patent: Sep. 19, 2000

[54] MECHANICALLY EXPANDABLE PAD

[75] Inventors: Yousef Georges Aouad, Cincinnati; Cynthia Lee Alvis, Fairfield; Denise Jean Bien, Cincinnati, all of Ohio

[73] Assignee: The Procter & Gamble Company, Cincinnati, Ohio

[21] Appl. No.: 09/106,936

[22] Filed: Jun. 30, 1998

[51] Int. Cl.[7] ..... A47K 7/02; B32B 3/02

[52] U.S. Cl. ..... 428/35.2; 428/36.5; 428/76; 428/152; 428/158; 428/188; 428/190; 428/192; 428/212; 15/244.3; 15/244.4; 15/209.1; 424/402; 604/358; 604/359; 604/385.1; 604/386

[58] Field of Search ..... 428/36.5, 76, 193, 428/152, 158, 212, 188, 190, 192, 35.2; 15/244.1, 244.3, 244.4, 209.1, 228; 424/401, 402; 604/358, 359, 385.1, 386

[56] References Cited

U.S. PATENT DOCUMENTS

| | | | |
|---|---|---|---|
| 2,101,073 | 12/1937 | Kingman | 91/54.7 |
| 3,848,594 | 11/1974 | Buell | 604/390 |
| 3,998,559 | 12/1976 | Hoyt | 401/132 |
| 4,323,656 | 4/1982 | Strickman et al. | 521/109 |
| 4,846,815 | 7/1989 | Scripps | 604/391 |
| 4,869,724 | 9/1989 | Scripps | 604/389 |
| 4,894,060 | 1/1990 | Nestegard | 604/391 |
| 4,946,527 | 8/1990 | Battrell | 156/60 |
| 4,970,750 | 11/1990 | Davis, III | 15/244.1 |
| 5,058,247 | 10/1991 | Thomas et al. | 24/448 |
| 5,387,290 | 2/1995 | Kolinsky | 134/32 |
| 5,491,864 | 2/1996 | Tuthill et al. | 15/118 |
| 5,882,769 | 3/1999 | McCormack et al. | 428/152 |

*Primary Examiner*—Rena L. Dye
*Attorney, Agent, or Firm*—Theodore P. Cummings; Jeffrey V. Bamber; Steven W. Miller

[57] ABSTRACT

This invention discloses a substantially flat mechanically expandable pad, i.e., one positioned almost exclusively in the x-y plane, having a expandable member therein that once activated expands the mechanically expandable pad out of the x-y plane and into the z-direction. Such activation occurs when cinch members are used to contract the expandable member in the x or y-directions but cause its expansion in the z-direction. The pad is useful for cleaning, polishing, buffing, etc. and the expandable member has application in other types of absorbent articles.

19 Claims, 7 Drawing Sheets

MECHANICALLY EXPANDABLE PAD

TECHNICAL FIELD

This invention discloses a substantially flat mechanically expandable pad, i.e., one positioned almost exclusively in the x-y plane, having an expandable member therein that once activated expands the mechanically expandable pad out of the x-y plane and into the z-direction. Such activation occurs when cinch members are used to contract the expandable member in the x and/or y-directions but cause its expansion in the z-direction.

BACKGROUND OF THE INVENTION

Pads for cleaning, polishing or buffing are known in the prior art. Such pads come in a variety of forms such as sponges for the absorbency of wastes and also for the delivery of certain cleaning agents absorbed therein. For example, U.S. Pat. No. 4,323,656 entitled Polyurethane Sponges Manufactured With Additive Dispersed Therein and issued on Apr. 6, 1982 discloses a synthetic polyurethane sponge manufactured with at least 5% of one or more additives dispersed therein. The additives may be surfactants, lotions, detergents, pesticides, lanolin, scouring particles, silicone oils, bath oils, or the like or combinations thereof.

Additionally, U.S. Pat. No. 4,970,750 entitled Cleaning Device and issued on Nov. 20, 1990 describes a cleaning device used for bathtubs, shower enclosures, and the like. It comprises a sponge block having an outer surface which substantially defines a rectangular polyhedron in shape and which has a cavity cut into a top surface thereof which is similarly shaped and oriented correspondingly as is the outer surface of the sponge block. Also, a rigid support block, having an outer surface with length and breadth dimensions which are approximately the same as the size and shape of the length and breadth dimensions of a cavity surface, is adhered in the cavity by a chemical (cleaning), detergent, and water resistant, elastic, adhesive and an elongated handle is attached to a top surface of the support block.

Likewise, U.S. Pat. No. 5,387,290 entitled Hand Polishing Technique For Automobile And Other Vehicles issued on Feb. 7, 1995 describes a method of hand cleaning or polishing an exterior body surface of a vehicle, e.g., an automobile, using a pad formed with a handle attachment part having a first flat surface substantially parallel with a bottom work surface of the pad. A handle is provided with a pad engaging part having a second flat surface.

What all of the prior art above, and other prior art like it, fail to teach is a mechanically expandable pad having mechanically expansive properties. Specifically the prior art does not provide for a mechanically expandable pad used in cleaning, polishing, buffing, etc. that can expand by a mechanical device inserted into the mechanically expandable pad.

Therefore, it is an object herein to provide a mechanically expandable pad that expands substantially out of the x-y plane and into the z-plane to form a puffed configuration.

SUMMARY OF THE INVENTION

Accordingly, the present invention provides a mechanically expandable pad residing substantially in the x-y plane having multiple layers and a center. Further, the mechanically expandable pad comprises a first layer having a pair of opposed end edges and a pair of opposed longitudinal edges to make up a periphery. A second layer is attached to the first layer. The mechanically expandable pad's opposed end edges and pair of opposed longitudinal edges making up the periphery of the mechanically expandable pad are shared by both the first layer and the second layer.

The mechanically expandable pad further comprises an expandable member having a first end and a second end positioned between the first layer and the second layer. Additionally, at least a pair of cinch members is attached to the expandable member; one at the first end of the expandable member and the other cinch member is attached to the second end of the expandable member, and preferably a confining channel houses the expandable member and the cinch members. The channel confines the relative motion of the expandable member and the cinch members in a prescribed direction; namely, in the x-plane.

Each cinch member extends out through openings positioned between the first layer and the second layer. When the cinch members are pulled in opposite directions, the ends of the expandable member are pulled toward the center of the mechanically expandable pad. Such pulling of the cinch members across the expandable member causes it to contract and thereby form either a densified zone in the pad or a raised and puffed mechanically expandable pad center or hump that substantially breaks the x-y plane of the mechanically expandable pad orientation and protrudes into the z-plane.

In an alternative embodiment of the invention, the mechanically expandable pad may further comprise a breakable package that is attached to the expandable member and/or the cinch members. When the ends of the expandable member are pulled toward the center of the mechanically expandable pad, the attached package breaks and releases at least one type of substance within the interior of the mechanically expandable pad. Preferably, the released substance will permeate through and substantially fill the interior of the pad. Also alternatively, the mechanically expandable pad may be so constructed as to allow the released substance(s) to disperse to and saturate either the first layer or the second layer or both layers of the mechanically expandable pad. The breakable package may comprise at least one material from the group consisting of perfume, oils, lotions, emollients, cyclodextrins, deodorizers, surfactants, medicines and mixtures thereof.

The breakable package may be multi-compartmental in one preferred embodiment. Further, each compartment of the multi-compartmental package may comprise a different substance. The substances in each compartment may be chosen from the group consisting of perfume, oils, lotions, emollients, cyclodextrins, deodorizers, surfactants, bleach, acid and mixtures thereof.

The first layer of the mechanically expandable pad may be either fluid permeable or impermeable and formed from material thereof Likewise, the mechanically expandable pad of the second layer may be fluid permeable or impermeable. In one embodiment, the first layer of the mechanically expandable pad may be used for cleaning, the second layer of the mechanically expandable pad may be used for polishing or buffing, and vice versa. Also, the mechanically expandable pad may form one or more shapes from the group consisting of circles, squares, stars, triangles, multi-sided shapes and combinations thereof.

The expandable member of the pad may comprise crease lines. These crease lines are normally oriented from one side of the confining channel and extend to one longitudinal edge of the expandable member. The crease lines may be formed between the top layer and bottom layer of the expandable member by a number of known bonding processes in the art including adhesive, heat and mechanical bonding.

BRIEF DESCRIPTION OF THE DRAWINGS

While the specification concludes with claims particularly pointing out and distinctly claiming the subject matter which is regarded as forming the present invention, it is believed that the invention will be better understood from the following descriptions which are taken in conjunction with the accompanying drawings in which like designations are used to designate substantially identical elements, and in which:

DETAILED DESCRIPTION OF THE INVENTION

Figure 1:
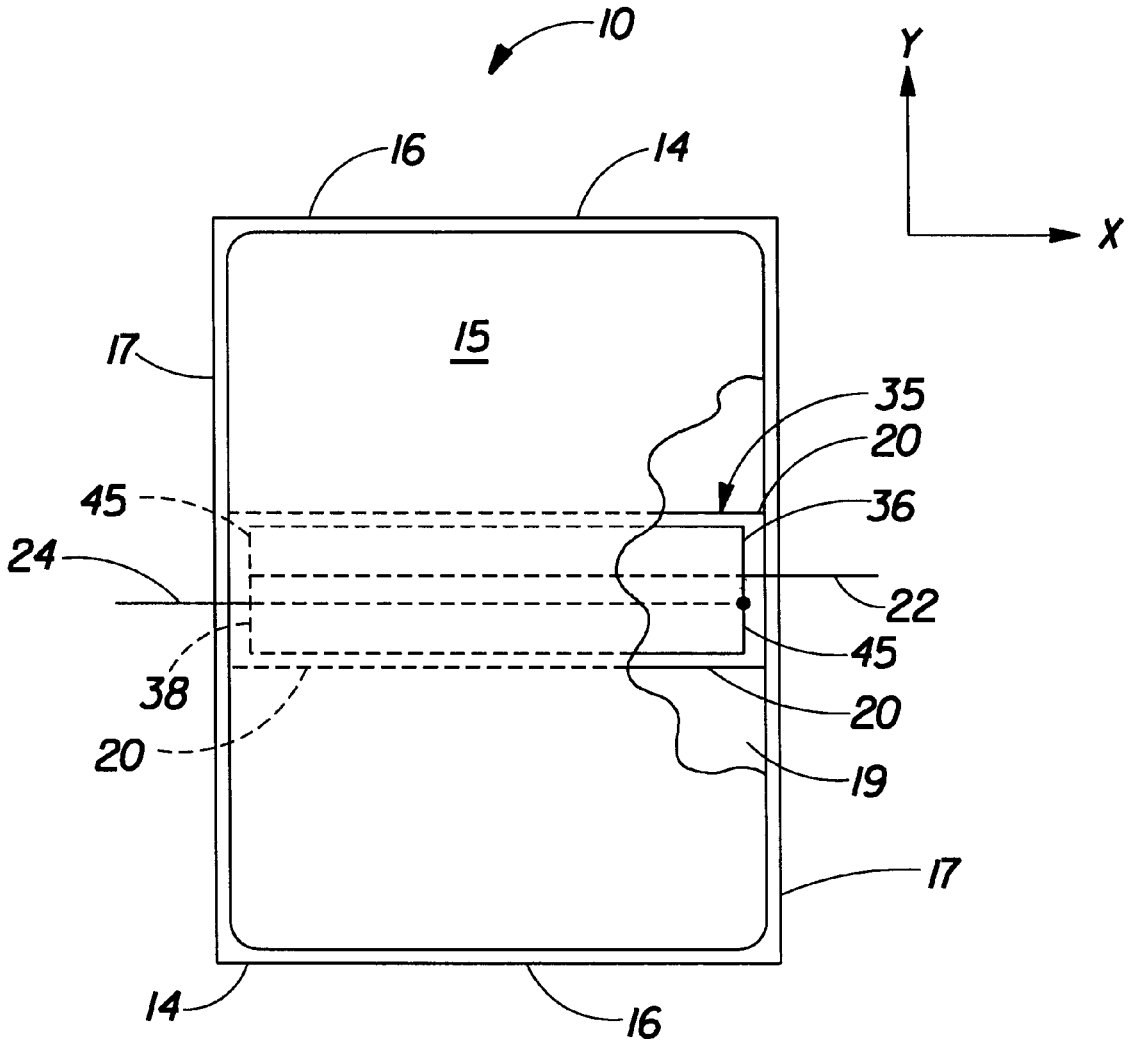
FIG. 1 is a plan view of the mechanically expandable pad laid out in the x-y plane in its pre-expanded configuration.

As is shown in FIG. 1, the present invention provides a mechanically expandable pad 10 residing substantially in the x-y plane having multiple layers and a center. Further, the mechanically expandable pad 10 comprises a first layer 15 having a pair of opposed end edges 16 and a pair of opposed longitudinal edges 17 to make up a periphery 14. A second layer 18 (not shown) is attached to the first layer 15. The mechanically expandable pad's 10 opposed end edges 16 and pair of opposed longitudinal edges 17 making up the periphery 14 of the mechanically expandable pad 10 are shared by both the first layer 15 and the second layer 18.

Figure 2:
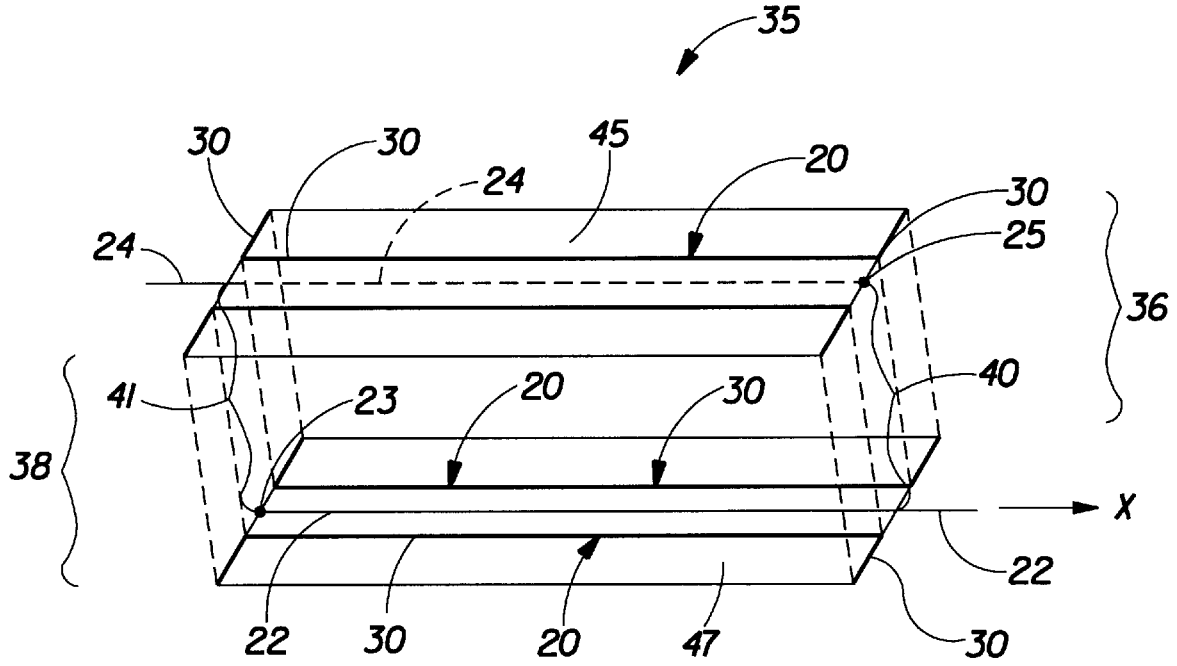
FIG. 2 is an exploded view of the mechanically expandable pad showing a cross-section of the first layer, second layer, the expandable member and cinch members.
Figure 3:
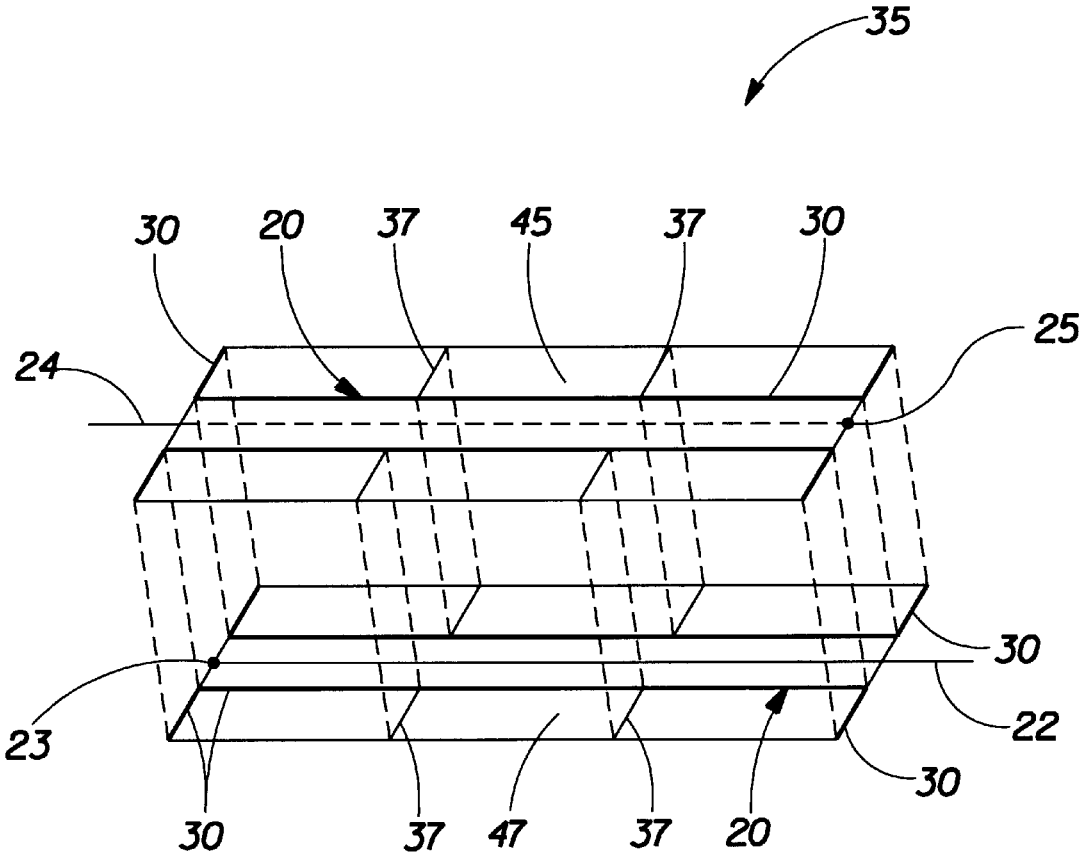
FIG. 3 is an exploded view of the mechanically expandable pad showing a cross-section of the first layer, second layer, the expandable member and cinch members.
Figure 4:
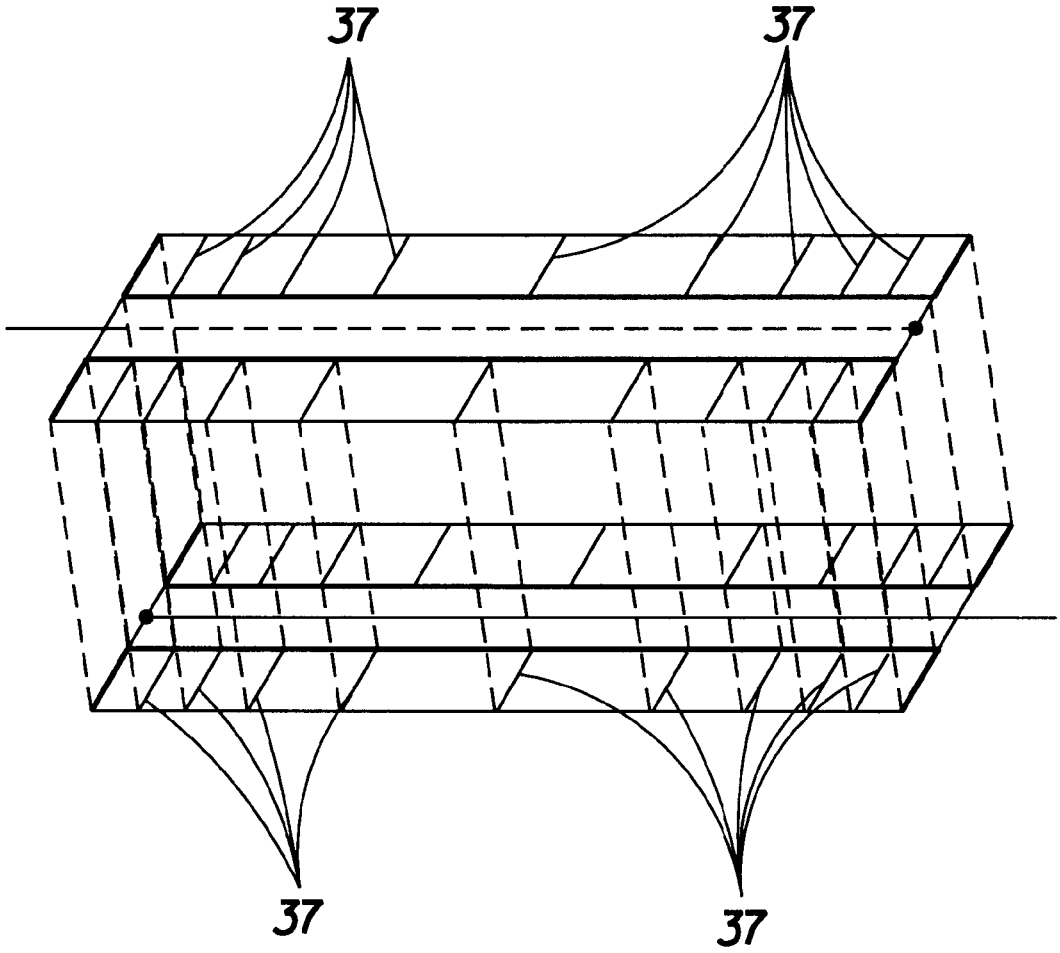
FIG. 4 is an exploded view of the mechanically expandable pad showing a cross-section of the first layer, second layer, the expandable member and cinch members.

The mechanically expandable pad 10 further comprises an expandable member 35 having a first end 36 and a second end 38 positioned between the first layer 15 and the second layer 18. Also, the expandable member 35 comprises a pair of longitudinal edges. Preferably, the expandable member 35 will comprise at least two layers, as is shown in FIGS. 2, 3, and 4. More specifically, the pad 10 will preferably comprise an expandable member 35 having a top layer 45 and a bottom layer 47. (FIGS. 2–4). In use, the end edges 36 and the longitudinal edges 38 of a multi-layered expandable member 35 line up with one another for attachment of layers along their aligned edges. Suitable materials for use for the top layer 45 or bottom layer 47 are nonwovens, sponge material, polyethylene, polypropylene, suede, vinyl, leather, any of several known polymeric materials in the art and combinations thereof.

Figure 9:
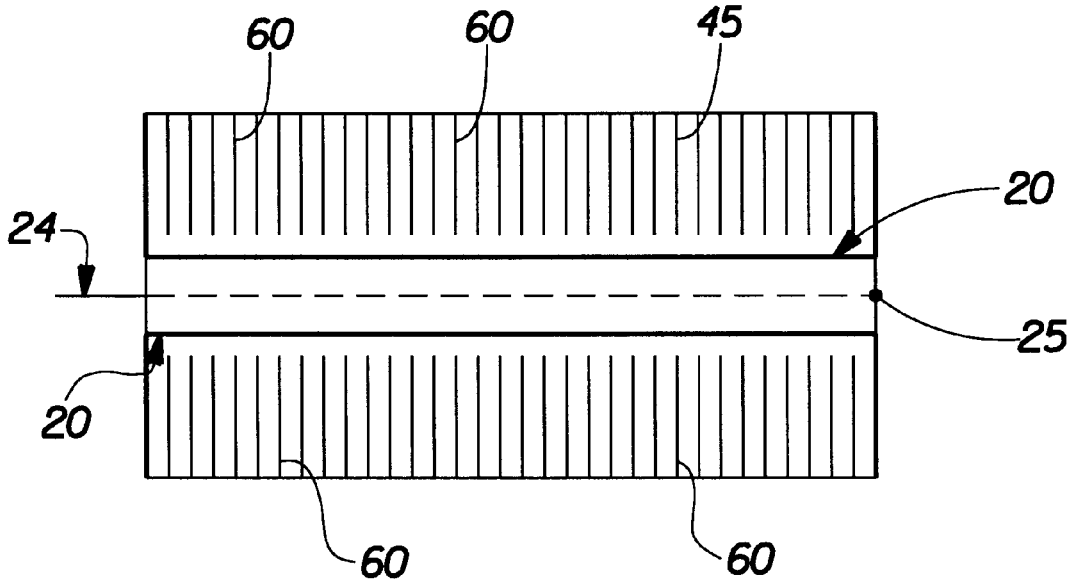
FIG. 9 is a plan view of the top layer of the expandable member.

The expandable member 35 may be fringed along its longitudinal edges. FIG. 9 shows a top plan view of the top layer 47 of the expandable member 35. As seen, fringes 60 line-up in a perpendicular orientation to the confining channel 20. The purpose of the fringes 60 is to provide greater surface area and bulkiness to the member 35. The fringes 60 shown in the top layer 47 correspond exactly to the fringes 60 (not shown) in the bottom layer 47 which is not shown. The fringes 60 most preferably consist of slits or cuts in the top layer 45 and the bottom layer 47. Such cutting can be done mechanically by a knife.

Additionally, the pad 10 will comprise cinch members attached thereto; e.g., first cinch member 22 and second cinch member 24. First cinch member 22 is attached to the bottom layer 47 at the connection point 23 which is along the second end edge 38 of the expandable member 35. In like fashion, second cinch member 24 is attached to the top layer 45 at the connection point 25 which is along the first end 36 of the expandable member 35. This orientation is formed such that the cinch members 22 and 24 may be pulled into the direction opposite to the side of the expandable member 35 on which they are attached. It is further noted herein that the first cinch member 22 is preferably positioned adjacent to the top surface of the bottom layer 47 of the member 35. Also preferably, the second cinch member 24 is positioned adjacent to the bottom surface of the top layer 45 of the member 35. The cinch members 22 and 24 are preferably attached at the connection points 23 and 25 by adhesive. However, the cinch members 22 and 24 may also be attached to the member 35 at the points 23 and 25 by mechanical means (such as crimping, embossing, etc.), ultrasonic bonding, thermal bonding, or any other suitable means known in the art.

In practice each cinch member (22 and 24) will be pulled in opposite directions through the top layer 45 and the bottom layer 47 of the expandable member 35. More specifically, the first cinch member 22 is positioned above the bottom layer 47 and the second cinch member is positioned below the top layer 45. In this configuration, each cinch member is pulled through openings 40 and 41. The openings 40 and 41 are formed by free spaces between the top layer 45 and the bottom layer 47 that are not attached to one-another. It should be noted herein that FIGS. 2–4 show exploded views of the expandable member 35. In practice, the top layer 45 and bottom layer 47 are attached to one-another about their periphery, which includes their end edges 16 and their longitudinal edges 17. Such attachment may be provided by adhesive, thermal bonds, ultrasonic bonds, crimping, embossing, and other mechanical means.

The expandable member 35 also comprises a confining channel 20 and connection lines 30. As shown in FIG. 1, the confining channel 20 extends in the direction of the x-axis from one longitudinal edge 17 to the other longitudinal edge 17. The confining channel 20 is a channel formed by creating a secure attachment along the connection lines 30 shown. The attachment is between the top layer 45 and the bottom layer 47. Between the connection lines 30 are portions of unattachment between the top layer 45 and the bottom layer 47 which make up the openings 40 and 41 of the expandable member 35. As is also shown, preferably, the connection lines 30 will extend along the first end 36 of the expandable member 35 and also along the second end 38 of the expandable member 35 to provide attachment along the ends 36 and 38 everywhere but at the openings 40 and 41. Again, the longitudinal edges 42 and 44 of the expandable member 35 are attached to one-another along their ends such that the expandable member 35 is jointly fitted and attached together everywhere except at the openings 40 and 41. The attachments formed between the top layer 45 and the bottom layer 47, the confining channel 20 and the connection lines are formed from suitable adhesives known in the art for use with absorbent articles. For example, the known adhesives in the art for securing a topsheet to a backsheet in a diaper, sanitary napkin or like article are highly desirable for the attachments listed above. Adhesives which have been found to be satisfactory are manufactured by H. B. Fuller. Company of St. Paul, Minn. under the designation HL-1258 or H-2031. Other suitable bonding processes known in the art may also be used; e.g., ultrasonic bonding, thermal bonding, and others.

When the cinch members 22 and 24 are pulled through their respective openings 40 and 41, the ends 36 and 38 of the expandable member 35 are pulled closer together, thereby causing the mechanically expandable pad 10 to elevate out of the x-y plane and into the z-plane. Such pulling of the cinch members 22 and 24 across the expandable member 35 forms a raised and puffed mechanically expandable pad center 70 which substantially breaks the x-y plane of the mechanically expandable pad orientation. (See FIGS. 5 and 6).

The hump 70 may be liquid transportive, liquid absorbent or have substantial qualities of both. Where the hump 70 is primarily liquid transportive, it will therefore operate as a liquid distribution mechanism. Specifically, the hump 70 will substantially not absorb liquids but will readily collect and distribute them to other liquid absorbing portions of the pad 10; e.g., where an absorbent element exists within the pad 10. Such liquid distribution is performed by components in the expandable member 35 specifically designed for such liquid distribution. Such components include the use of inherently hydrophobic fibers, polyethylene fibers, polypropylene fibers, capillary channel fibers, and cellulosic fibers treated with a hydrophobic agent thereon; this list is not meant to be exhaustive. In fact, any fibers which are hydrophobic or made to be hydrophobic and are known in the art to be suitable for the use in an absorbent article are envisioned for the expandable member 35.

In addition, the expandable member 35 may be liquid absorbent. Specifically, the member 35 may comprise absorbent elements which allow it readily receive and absorb liquids. These elements may be taken from the group consisting of cellulose fibers, functional absorbent materials (i.e., foam), spongy materials, fibers treated to become hydrophilic and any other type of absorbent material known in the art an suitable for the pad 10 herein. In one embodiment of an absorbent pad 10, absorbent gelling material may be used within the expandable member 35 to lock-in liquids at contact thereof.

As mentioned above, the pad 10 may comprise substantial elements of both liquid distribution and absorbency. That is, the pad 10 may one part distributive and comprise the above-mentioned elements therefor and also another part absorbent and therefore also comprising the necessary elements of absorbency mentioned above.

Figure 5:
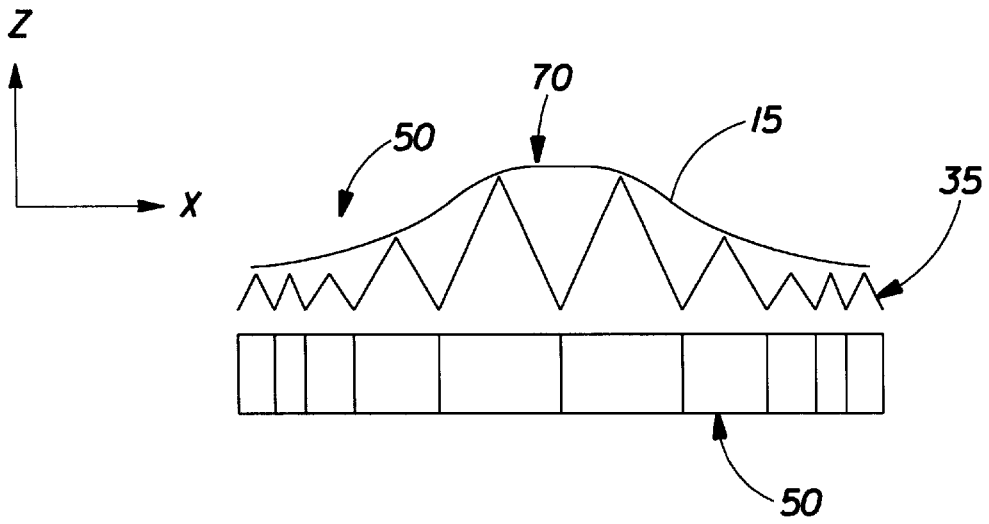
FIG. 5 is a cross-sectional view of the expandable member combined with a top view of a cinch profile.

FIGS. 3 and 4 show alternative embodiments of the embodiment shown in FIG. 2. FIG. 3 additionally comprises crease lines 37 which are additional lines of attachment between the top layer 45 and the bottom layer 47 of the expandable member 35. The use of the crease lines 37 creates cinch profiles 50 (FIGS. 5 and 6) whereby the expandable member 35 will cinch or hump in a prescribed fashion corresponding to the settings of the crease lines. For example, FIG. 5 shows a cinch profile made up of a crease line 37 pattern which causes the resultant cinch profile 50 of the expandable member 35. Furthermore, in a multi-layered member 35, this cinch profile 50 also indicates that the top layer 45 of the member 35 is more rigid than the bottom layer 47. When the top layer 45 and the bottom layer 47 comprise materials having differing rigidities, whichever layer is most flexible will be the layer that partially, nearly or substantially conforms to the more rigid layer. At this conformity, especially where it is the pronounced sort shown in FIG. 5, one layer of the expandable member 35 will be substantially elevated in the z-plane while the other layer either conforms substantially to the elevated layer or remains substantially planar; i.e., the less rigid layer either remains substantially planar or elevates to conform with the humps or creases of the more rigid layer.

The crease lines 37 may be formed by adhesive such as that used to attach the top layer 45 and the bottom layer 47 of the expandable member 35. Additionally, the crease lines 37 may be formed from any suitable bonding process which will bind, i.e., attach, those portions of the top layer 45 and the bottom layer 47 shown in FIGS. 3–5. Such bonding techniques include thermal bonding, ultrasonic bonding, crimping, embossing and any other suitable mechanical bonding technique known in the art. Furthermore, any known bonding technique in the art suitable for attaching top layer 45 and bottom layer 47 is hereby proscribed herein.

Figure 6:
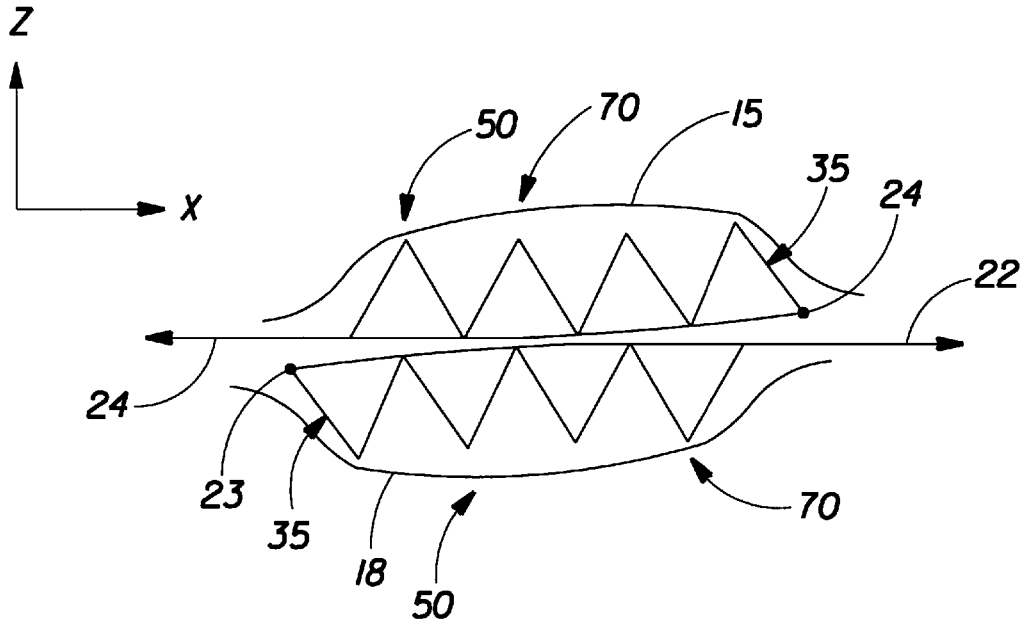
FIG. 6 is a cross-sectional view of an alternative embodiment of the expandable member.

Obviously, such one-sided conformity is important where it is desired to create a pad 10 that "puffs" or "humps" substantially in one direction. By the terms "puffs" or "humps" it is meant herein that the expandable member 35 will move out of the x and y planes and into the z-plane. However, FIG. 6 shows an embodiment wherein both sides of the member 35 expand out of the x and y planes and into the z-plane. Generally, this occurs when the multiple layers of the expandable member 35 are at least of approximately equal rigidity. This is also an important feature because for certain functions it may be desired to have a pad 10 which comprises a two-sided hump 70.

In an alternative embodiment herein, the exapandable member 35 may not form a hump 70 but rather a densification zone 70. Specifically, the densification zone 70 is a zone formed from the contracted member 35 that does not substantially form a hump; i.e., does not substantially protrude into the z-plane. At such contraction of the member 35, a densified portion 70 is formed which substantially does not break into the z-plane. Therefore, the expandable member 35, when contracted, will develop into one of two forms: 1) a densified zone 70 that does not substantially elevate into the z-plane or 2) a hump 70 which does substantially elevate into the z-plane.

The importance of a densification zone 70, of which there may be many such zones 70, is to provide densified zones of liquid collection, distribution and/or absorption. The zones 70 may, upon collection of liquids distribute the liquid to other portions of the pad 10. Otherwise or additionally, a densification zone may provide absorption of the aforesaid liquids, for example, right at the point of liquid impact.

Figure 7:
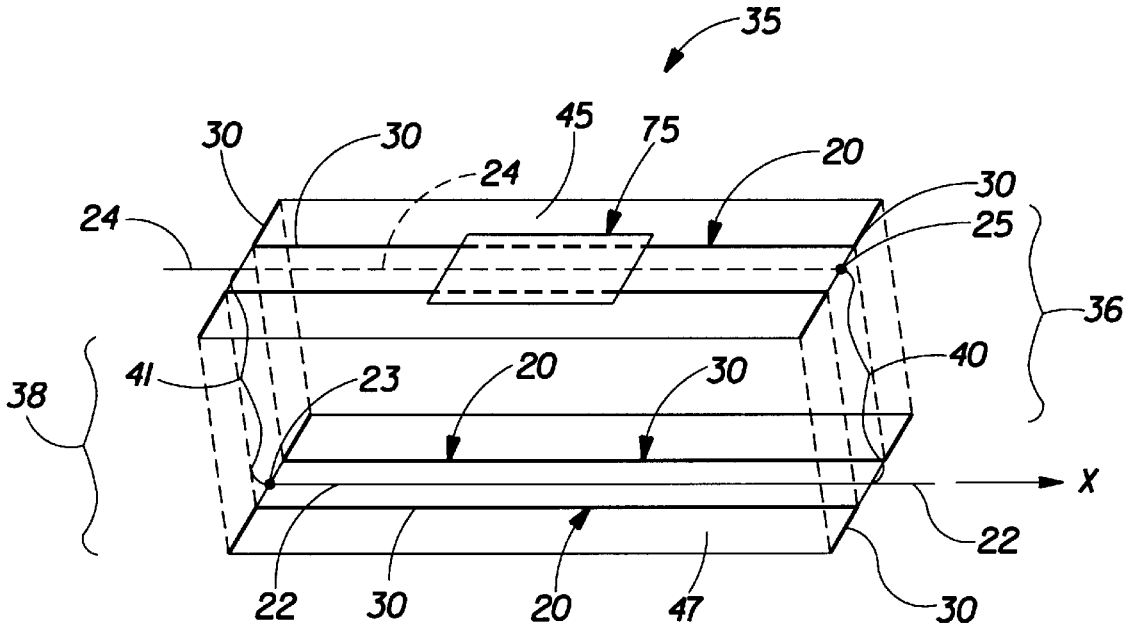
FIG. 7 is an exploded view of an expandable member with a breakable package thereon.

In an alternative embodiment of the invention as shown in FIG. 7, the mechanically expandable pad 10 may further comprise a breakable package 75 that is attached to the expandable member 35. Note that alternatively, the breakable package 75 may also or separately be attached to one or both of the cinches 22 and/or 24. When the ends 36 and 38 of the expandable member 35 are pulled toward one-another, the attached package 75 breaks and releases at least one type of substance within the interior of the mechanically expandable pad 10. Also alternatively, the mechanically expandable pad 10 may be so constructed as to allow the released substance(s) to disperse to and saturate through the first layer 15 and/or the second layer 18 of the mechanically expandable pad 10. The breakable package 75 may comprise at least one material from the group consisting of perfume, oils, lotions, emollients, cyclodextrins, deodorizers, surfactants, bleaches, acids, alcohols and mixtures thereof.

It is conceivable herein to provide a mechanically expandable pad for washing, cleaning or scrubbing in which all of the necessary substances to perform a task are located within the mechanically expandable pad 10 and released upon expansion of the mechanically expandable pad into the z-direction. It is also conceived herein that a mechanically expandable pad 10 having cinch members 22 and 24 may be employed that does not expand into the z-plane but rather, when such cinch members are activated, a breakable package attached thereto is broken and its substance dispersed into and throughout the mechanically expandable pad to perform a pre-determined function.

Figure 8:
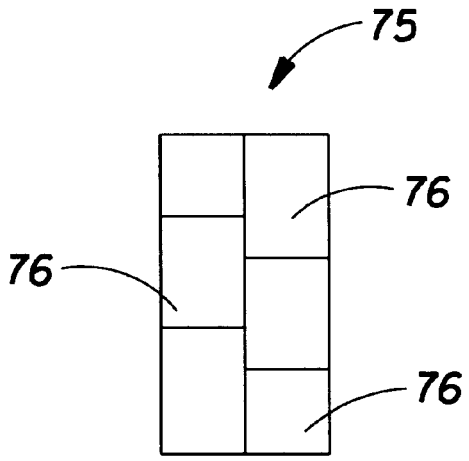
FIG. 8 is a plan view of a multi-compartmental breakable package.

As is shown in FIG. 8, the breakable package 75 may be multi-compartmental in one preferred embodiment. Further, each compartment 76 of the multi-compartmental package may comprise differing substances. The substances in each compartment may be chosen from the group consisting of perfumes, oils, lotions, emollients, cyclodextrins, deodorizers, surfactants, bleaches, bleach activators, chelants, builders, polymers, disinfectnats, acids, bases, alcohols and mixtures thereof. The breakable package 75 may be formed from polyethylene, polypropylene, nonwovens, or paper.

The first layer 15 of the mechanically expandable pad 10 may be either fluid permeable or impermeable and formed from material thereof. Likewise, the second layer may be fluid permeable or impermeable. In one embodiment, the first layer 15 of the mechanically expandable pad 10 may be used for cleaning; the second layer 18 of the mechanically expandable pad 10 may be used for polishing or buffing, and vice versa. Also, the mechanically expandable pad 10 may form one or more shapes from the group consisting of circles, squares, stars, triangles, multi-sided shapes and combinations thereof.

Suitable materials for use for the first layer 15 or second layer 18 are nonwovens, sponge material, polyethylene, polypropylene, suede, vinyl, leather, any of several known polymeric materials in the art and combinations thereof. It is also important to note that where the pad 10 comprises a bleach, acid or other toxic substance therein that the material used in the pad be fully resistant to molecular breakdown and decomposure.

Where either the first layer 15 and/or the second layer 18 is liquid permeable, the layers may be compliant, soft feeling, and non-irritating to the user's skin. Further, a liquid permeable layer permits liquids to readily penetrate through its thickness. A suitable liquid permeable layer may be manufactured from a wide range of materials, such as porous foams; reticulated foams; apertured plastic films; or woven or nonwoven webs of natural fibers (e.g., wood or cotton fibers), synthetic fibers (e.g., polyester or polypropylene fibers), or a combination of natural and synthetic fibers. If the liquid permeable layer is made of a hydrophobic material, at least the upper surface thereof is treated to be hydrophilic so that liquids will transfer through the liquid permeable layer more rapidly. The liquid permeable layer can be rendered hydrophilic by treating it with a surfactant. Suitable methods for treating the liquid permeable layer with a surfactant include spraying the material with the surfactant and immersing the material in the surfactant. A more detailed discussion of such a treatment and hydrophilicity is contained in U.S. Pat. No. 4,988,344 entitled "Absorbent Articles With Multiple Layer Absorbent Layers" issued to Reising, et al. of Jan. 29, 1991.

There are a number of manufacturing techniques which may be used to manufacture the liquid permeable layer. For example, the liquid permeable layer may be a nonwoven web of fibers. When the liquid permeable layer comprises a nonwoven web, the web may be spunbonded, carded, wet-laid, meltblown, hydroentangled, combinations of the above, or the like. A preferred liquid permeable layer is carded and thermally bonded by means well known to those skilled in the fabrics art. A preferred liquid permeable layer comprises staple length polypropylene fibers having a denier of about 2.2. As used herein, the term "staple length fibers" refers to those fibers having a length of at least about 15.9 mm (0.625 inches). Preferably, the liquid permeable layer has a basis weight from about 18 to about 25 grams per square meter. A suitable liquid permeable layer is manufactured by Veratec, Inc., a Division of International Paper Company, of Walpole, Mass. under the designation P-8.

Either the first layer 15 and/or the second layer 18 may be liquid impervious to liquids. Such a liquid impervious layer is preferably manufactured from a thin plastic film, although other flexible liquid impervious materials may also be used. As used herein, the term "flexible" refers to materials which are compliant and will readily conform to the general shape and contours of the human body. The liquid impervious layer may thus comprise a woven or nonwoven material, polymeric films such as thermoplastic films of polyethylene or polypropylene, or composite materials such as a film-coated nonwoven material. Preferably, the liquid impervious layer is a thermoplastic film having a thickness of from about 0.012 mm (0.5 mil) to about 0.051 mm (2.0 mils). The liquid impervious layer preferably comprises a polyethylene blend film of about 0.025 mm (1.0 mil) as is manufactured by Tredegar Corporation of Terre Haute, Ind. and marketed as P8863.

Preferably, once the cinch members 22 and 24 are pulled or extended through openings 40 and 41, the cinch members will remain stationary such that the expanded structure of the expandable member 35 will remain in its expanded configuration. To these ends, one embodiment herein contemplates providing the cinch members with tape tabs and/or hooks and loops (i.e., fastening systems) so that when the cinch members 22 and 24 are pulled, they may either be brought around to either the first layer 15 or second layer 18 of the mechanically expandable pad 10 and be secured thereto or secured to one-another. If, for example, the second layer 18 comprises a nonwoven layer, the ends of the cinch members 22 and 24 may have attached thereon a tab comprising hooks which can engage the nonwoven second layer 18 and remain fixed thereto. Alternatively, if the second layer comprises polymer material, the ends of the cinch members 22 and 24 may likewise comprise tape tabs that readily adhere to the polymer layer. Preferably, such tape tabs would also be readily releasable from the polymer layer. These cinch member attachments devices notwithstanding, preferably the cinch members 22 and 24 are constructed such that when they are pulled, the expandable member 35 remains in a cinched position by virtue of the rigidity of one or more of the layers (top 45 or bottom 47) that make-up the expandable member 35.

Exemplary fastening systems are disclosed in U.S. Pat. No. 4,846,815 entitled "Disposable Diaper Having An Improved Fastening Device" issued to Scripps on Jul. 11, 1989; U.S. Pat. No. 4,894,060 entitled "Disposable Diaper With Improved Hook Fastener Portion" issued to Nestegard on Jan. 16, 1990; U.S. Pat. No. 4,946,527 entitled "Pressure-Sensitive Adhesive Fastener And Method of Making Same" issued to Battrell on Aug. 7, 1990; U.S. Pat. No. 3,848,594 entitled "Tape Fastening System for Disposable Diaper" issued to Buell on Nov. 19, 1974; U.S. Pat. No. 4,662,875 entitled "Absorbent Article" issued to Hirotsu et al. on May 5, 1987; and the herein before referenced U.S. Pat. Application Ser. No. 07/715,152; each of which is incorporated herein by reference. Exemplary fastening systems comprising mechanical fastening components (i.e., hooks and loops) are described in U.S. Pat. No. 5,058,247 entitled "Mechanical Fastening Prong" issued to Thomas Oct. 22, 1991; U.S. Pat. No. 4,869,724 entitled "Mechanical Fastening Systems With Adhesive Tape Disposal Means For Disposal of Absorbent Articles" issued to Scripps on Sep. 26, 1989; and U.S. Pat. No. 4,846,815 entitled "Disposable Diaper Having an Improved Fastening Device" issued to Scripps on Jul. 11, 1989. An example of a fastening system having combination mechanical/adhesive fasteners is described in U.S. Pat. No. 4,946,527 entitled "Pressure-Sensitive Adhesive Fastener and Method of Making Same" issued to Battrell on Aug. 7, 1990. Each of these patents are incorporated herein by reference.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A mechanically expandable pad residing substantially in the x-y plane and expandable in the z-direction having multiple layers and a center, comprising:

a first layer having a pair of opposed end edges and a pair of opposed longitudinal edges to make up a periphery;

a second layer attached to the first layer, having a pair of opposed end edges and a pair of opposed longitudinal edges to make up a periphery, the first layer and the second layer sharing the same periphery;

an expandable member having a first end and a second end positioned between the first layer and the second layer;

at least a pair of cinch members, one said cinch member being attached at the first end of the expandable member, the other said cinch member being attached to the second end of the expandable member; and a confining channel housing the expandable member and the cinch members, said channel confining the relative motion of the expandable member and the cinch members in a prescribed direction, each said cinch member extending out through the first layer and the second layer such that when the cinch members are pulled oppositely to one-another, the ends of the expandable member are pulled toward the center of the mechanically expandable pad to form a raised and puffed mechanically expandable pad center which substantially breaks the x-y plane of the mechanically expandable pad orientation, said raised and puffed mechanically expandable pad center protruding into the z-direction.

2. The mechanically expandable pad of claim 1 wherein the expandable member comprises multiple layers.

3. The mechanically expandable pad of claim 2 wherein the expandable member consists of two layers, each said layer having a pair of end edges and a pair of longitudinal edges.

4. The two-layered expandable member of claim 3 wherein the layers are substantially attached along the end edges and the longitudinal edges of each said layer.

5. The two-layered expandable member of claim 4 wherein an opening between the two layers is formed at each joined end edge of the attached layers.

6. The expandable member of claim 5 wherein one said cinch member is attached to one said end edge of one said layer and the other said cinch member is attached to the opposite said end edge of the second layer.

7. The mechanically expandable pad of claim 1 wherein the mechanically expandable pad further comprises absorbent material positioned between the first layer and second layer.

8. The mechanically expandable pad of claim 1 wherein a breakable package is attached to the expandable member such that when the ends of the expandable member are pulled toward the center of the mechanically expandable pad, the attached package breaks releasing at least one substance.

9. The mechanically expandable pad of claim 2 wherein the breakable package comprises at least one material from the group consisting of perfume, oils, lotions, emollients, cyclodextrins, deodorizers, surfactants, bleaches, bleach activators, chelants, builders, polymers, disinfectants, acids, bases and mixtures thereof.

10. The mechanically expandable pad of claim 2 wherein the breakable package is multi-compartmental.

11. The mechanically expandable pad of claim 4 wherein each said compartment of the multi-compartmental package comprises a different material.

12. The mechanically expandable pad of claim 5 wherein the material in each said compartment is from the group consisting of perfume, oils, lotions, emollients, cyclodextrins, deodorizers, surfactants, bleaches and acids and mixtures thereof.

13. The mechanically expandable pad of claim 1 wherein the first layer is a fluid permeable material.

14. The mechanically expandable pad of claim 1 wherein the first layer is a fluid impermeable material.

15. The mechanically expandable pad of claim 1 wherein the second layer is a fluid permeable material.

16. The mechanically expandable pad of claim 1 wherein the second layer is a fluid impermeable material.

17. The mechanically expandable pad of claim 1 wherein the mechanically expandable pad can be at least one of the shapes from the group consisting of circles, squares, stars, triangles, multi-sided shapes and combinations thereof.

18. The mechanically expandable pad of claim 1 wherein the expandable member comprises crease lines, each said crease line being oriented perpendicularly from the confining channel and extending from one side of the confining channel to the longitudinal edge of the expandable member.

19. The mechanically expandable pad of claim 1 wherein the longitudinal edges of the expandable member are fringed.

* * * * *